US009359883B2

(12) United States Patent
Whittaker et al.

(10) Patent No.: US 9,359,883 B2
(45) Date of Patent: Jun. 7, 2016

(54) ZONAL COMPOSITIONAL PRODUCTION RATES IN COMMINGLED GAS WELLS

(71) Applicant: Schlumberger Technology Corporation, Sugar Land, TX (US)

(72) Inventors: Andrew Colin Whittaker, Bangkok (TH); A. Ballard Andrews, Wilton, CT (US); Andrew Speck, Milton, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 317 days.

(21) Appl. No.: 13/948,105

(22) Filed: Jul. 22, 2013

(65) Prior Publication Data

US 2015/0021020 A1 Jan. 22, 2015

(51) Int. Cl.

| | |
|---|---|
| ***E21B 43/14*** | (2006.01) |
| ***E21B 47/06*** | (2012.01) |
| ***E21B 47/10*** | (2012.01) |

(52) U.S. Cl.

CPC ..... *E21B 47/06* (2013.01); *E21B 43/14* (2013.01); *E21B 47/10* (2013.01)

(58) Field of Classification Search

CPC ..... E21B 43/14; E21B 47/06; E21B 47/10
USPC ..... 166/254.2, 255.1, 255.2, 250.01
See application file for complete search history.

(56) References Cited

U.S. PATENT DOCUMENTS

| | | | | |
|---|---|---|---|---|
| 5,095,983 | A * | 3/1992 | Magnani | 166/250.01 |
| 5,597,042 | A * | 1/1997 | Tubel et al. | 166/250.01 |
| 2011/0005745 | A1* | 1/2011 | Goodwin | 166/250.01 |
| 2011/0139442 | A1* | 6/2011 | Ziauddin et al. | 166/250.01 |

FOREIGN PATENT DOCUMENTS

| | | |
|---|---|---|
| WO | 2013/090108 | 6/2013 |

* cited by examiner

*Primary Examiner* — Doug Hutton, Jr.
*Assistant Examiner* — Silvana Runyan

(57) ABSTRACT

A production logging tool (PLT) is conveyed within production tubing containing production fluid flow established by zonal fluid flow from formation zones. The PLT measures a flow rate of the production fluid flow at each of a plurality of depths associated with a corresponding one of the zones. A flow rate of the zonal fluid flow from each zone is determined based on the flow rates of the production fluid flow measured at each of the depths. The PLT measures proportions of compositional components of the production fluid flow at each of the depths. A flow rate of each compositional component of the zonal fluid flow from each zone is determined based on the determined flow rate of the zonal fluid flow from each zone and the proportions of compositional components of the production fluid flow measured at each of the depths.

17 Claims, 9 Drawing Sheets

ZONAL COMPOSITIONAL PRODUCTION RATES IN COMMINGLED GAS WELLS

BACKGROUND OF THE DISCLOSURE

Downhole fluid analysis (DFA) in the petroleum industry provides identification of subterranean fluid characterization and variations in real time. DFA has contributed to the finding that hydrocarbons may be compositionally varied rather than homogeneously distributed, such as may be due to gravity, thermal gradients, biodegradation, water stripping, leaky seals, real time charging, multiple charging, and miscible sweep fluid injection, among other possible factors. However, DFA is currently performed via open-hole and cased-hole sampling tools that form a seal around a section of the borehole wall, or around casing perforations. That is, fluids in the formation are brought into the interior of the downhole tool where DFA is performed. As a result, DFA measurements may be restricted to station measurements, which may not be possible in many production logging environments. Moreover, existing DFA tools may have a larger diameter than can be accommodated in some production logging implementations, and may be conveyed within the wellbore via a larger diameter cable than can be accommodated while maintaining a pressure seal on a flowing well.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Embodiments of this disclosure relate to various methods and devices for determining a flow rate of a zonal fluid flow at multiple depths in a production fluid flow. In one embodiment, a method includes conveying a tool within tubing having a zonal fluid flow and operating the tool to measure a flow rate of the fluid flow at multiple depths. Each of the multiple depths is associated with a corresponding zone of the zonal fluid flow. The method further includes determining a flow rate of the zonal fluid flow from each of the zones based on the flow rates of the fluid flow measured at each of the zone-associated depths and operating the tool to measure proportions of compositional components of the fluid flow at each of the zone-associated depths. The flow rate of each compositional component of the zonal fluid flow from each of the zones is determined based on the determined flow rate of the zonal fluid flow from each of the zones and the proportions of compositional components of the production fluid flow measured at each of the zone-associated depths.

Embodiments of the disclosure are also related to a method including conveying a production logging tool (PLT) within production tubing containing production fluid flow established by zonal fluid flow into the production tubing from zones of a subterranean formation through which the production tubing extends and operating the PLT to measure a flow rate of the production fluid flow at each of multiple depths. Each of the multiple depths is associated with a corresponding zone. The method includes positioning the PLT adjacent one of the zones and then varying a drawdown pressure while operating the PLT to measure proportions of compositional components of the production fluid flow at the PLT-adjacent zone-associated depth and determining a flow rate of each compositional component of the zonal fluid flow from the PLT-adjacent zone. The flow rate of each compositional component of the zonal fluid flow from the PLT-adjacent zone is based on the flow rate of the zonal fluid flow determined from the PLT-adjacent zone and the proportions of compositional components of the production fluid flow measured at the PLT-adjacent zone-associated depth. The condensate banking within the PLT-adjacent zone is assessed based on the determined flow rate of each compositional component of the zonal fluid flow from the PLT-adjacent zone.

Additionally, embodiments of the disclosure is related to an apparatus having a tool operable to be conveyed within tubing containing fluid flow established by zonal fluid flow into the tubing from zones of a subterranean formation through which the tubing extends. The tool includes a flow module operable to measure a flow rate of the fluid flow at each of a plurality of depths associated with a corresponding one of the zones and a sensor operable to measure proportions of compositional components of the fluid flow at each of the zone-associated depths. The apparatus also includes a controller operable to determine a flow rate of the zonal fluid flow from each of the zones based on the flow rates of the fluid flow measured at each of the zone-associated depths and determine a flow rate of each compositional component of the zonal fluid flow from each of the zones based on the determined flow rate of the zonal fluid flow from each of the zones and the proportions of compositional components of the fluid flow measured at each of the zone-associated depths.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
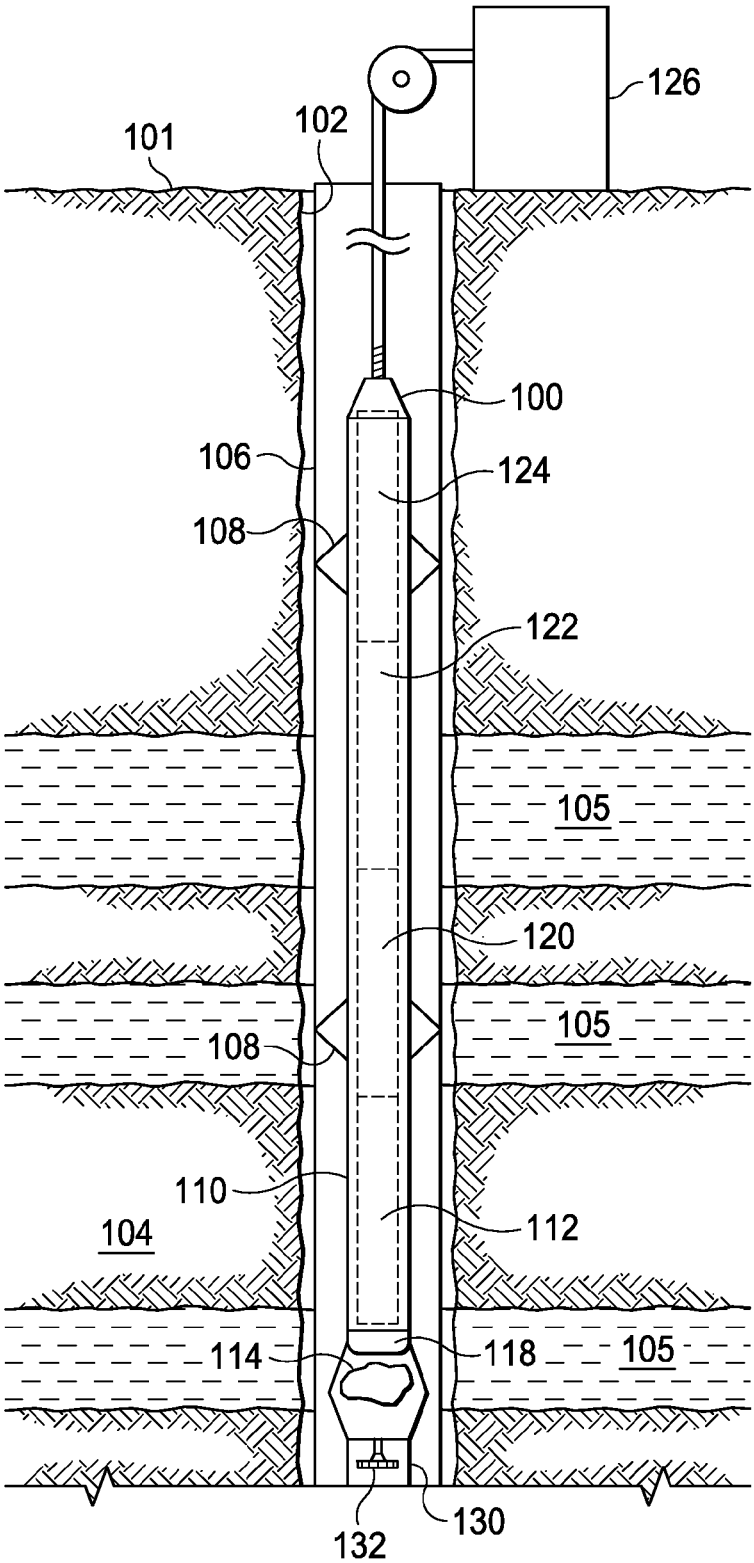
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Furthermore, the terms "casing" and "production tubing" may be used interchangeably within the scope of the present disclosure, contrary to their conventional meanings in the art. Thus, in the context of the present disclosure, including the claims, the term "casing" may indicate a casing, production tubing, a casing through which production tubing extends, and/or production tubing extending through a casing, as these terms are conventionally interpreted. Similarly, the term "production tubing" may indicate production tubing, a casing, production tubing extending through a casing, and/or a casing through which production tubing extends, as these terms are conventionally interpreted.

In addition, one or more aspects of the present disclosure may be applicable and/or readily adaptable to open-hole implementations. Accordingly, any reference herein to "casing" or "production tubing" may also indicate an open, barefoot, or non-cased wellbore, where appropriate, including in the claims.

FIG. 1 is a schematic view of at least a portion of apparatus according to one or more aspects of the present disclosure. The apparatus depicted in FIG. 1 comprises at least a portion of a downhole tool that is or comprises a production logging tool ("PLT") and may thus be referred to herein as the PLT 100. The PLT 100 is operable for conveyance within a borehole 102 that traverses a subterranean formation 104. The borehole 102 may include a casing 106 through which the PLT 100 is conveyed via a wireline, slickline, and/or other cable. The PLT 100 may comprise one or more centralizers 108 operable to aid in centering and/or otherwise orienting the PLT 100 within the casing 106 and/or the borehole 102. During production logging, formation fluid (e.g., formation liquid and/or formation gas) may be extracted from different zones, pay zones, and/or layers (hereafter collectively referred to simply as "zones") 105 of the formation 104. The PLT 100 is operable to measure, detect, and/or monitor flow rate, composition, and/or other properties and characteristics of the formation fluid as the formation fluid flows to surface 101.

The PLT 100 comprises a housing 110 that may contain or be at least partially formed by one or more modules. For example, one such module may be an optical module 112 operable to perform spectroscopic measurements on a sample of the formation fluid 114. The optical module 112 may be disposed at or near an end of the housing 110 (as shown in FIG. 1), and may be operable to perform Raman spectroscopy, laser induced breakdown spectroscopy, and/or other forms of spectrometry. The optical module 112 may comprise optics, a laser and/or other light source, and one or more detectors. For example, in implementations in which the optical module 112 utilizes back-scattering spectroscopy, the laser and/or other light source generates light that is utilized to analyze the formation fluid sample 114, where the light that scatters back from the sample 114 is detected by the one or more detectors. The optics are operable to, for example, communicate the light to and from the sample 114. For example, the optics may include a window 118 that may place the optical module 112 in optical communication with the formation fluid sample 114. As such, the formation fluid sample 114 adjacent the window 118 may be analyzed by the optical module 112. In the implementation depicted in FIG. 1, the window 118 is located at the lower end of the PLT 100. However, instead of being located at the end of the PLT, or in addition thereto, the window may be located on a sidewall of the housing 110.

As schematically depicted in FIG. 1, the PLT 100 may also comprise a flow module 130 operable to measure flow rates of the production fluid flow. For example, the flow module 130 may comprise an impeller or other member 132, wherein the production fluid flow may impart rotary and/or other motion to the member 132. The imparted motion sensed by one or more detectors of the flow module 130 may be proportional or otherwise related to the rate of production fluid flow. The flow module 130, perhaps with other portions of the PLT 100, may be or comprise the PS Platform of Schlumberger®, among other possible commercially available flow rate tools.

The PLT 100 may also comprise one or more other modules that may operationally support the optical module 112 and/or the flow module 130. For example, the PLT 100 may comprise a power module 120 operable to at least partially power the light source(s) and the detector(s) of the optical module 112 and/or the flow module 130. An amplification module 122 may be included in the PLT 100 to, for example, amplify electrical and/or other signals output from the optical module 112 and/or the flow module 130. Such signals output from the optical module 112 may comprise one or more electrical and/or other type of signals that may be representative of light scattered back from the formation fluid sample 114 that is detected by the one or more detectors of the optical module 112. The signals output from the flow module 130 may comprise one or more electrical and/or other type of signals that may be representative of the flow rate of fluid flow within the casing 106 that is detected by the one or more detectors of the flow module 130. The PLT 100 may also comprise a telemetry module 124 operable to provide communication between the PLT 100 and surface electronics and processing equipment 126. For example, the telemetry module 124 may communicate electrical and/or other signals from the optical module 112 and/or the flow module 130 to the surface 101.

The PLT 100 may be utilized in a comingled gas/gas condensate well according to one or more aspects of the present disclosure. The pressures, temperatures, and fluid densities encountered in gas/gas condensate wells may produce a multi-phase flow with a phase separation as the gas and liquid flow to the surface 101. The phase separation may produce an annular flow pattern with the gas fraction flowing in the middle of the casing 106 and the fluid fraction flowing against the sides of the casing 106. The centralizers 108 may centrally position the optical sensor(s) to allow the gas fraction to be separately sampled, avoiding interference from the fluid fraction. The optical module 112 may be operable to analyze various different types of gases, including methane ($CH_4$), ethane ($C_2H_6$), propane ($C_3H_8$), butane ($C_4H_{10}$), pentane ($C_5H_{12}$), hexane ($C_6H_{14}$), heptane ($C_7H_{16}$), octane ($C_8H_{18}$), nonane ($C_9H_{20}$), decane ($C_{10}H_{22}$), carbon dioxide ($CO_2$), hydrogen sulfide ($H_2S$), and nitrogen ($N_2$), among others. The optical module 112 may be operable to analyze liquid fractions comprising hydrocarbons such as n-alkanes and/or other saturates, among other hydrocarbons, and/or aromatics such as benzene and m-xylene, among others. The liquid fraction may also comprise water and/or a multiphase mixture comprising one or more gases, liquid hydrocarbons, and/ or water. The optical module 112 may be operable to perform and/or otherwise utilize Raman spectroscopy in conjunction with a pulsed laser light source to determine the above examples of compositional components in the formation fluid sample 114, such as described in implementations described below or otherwise within the scope of the present disclosure.

In implementations in which the above-described back-scattering spectrometry is employed, an axis of the excitation beam of the laser and/or other light source may be collinear with an axis of the detected light. As such, the compositional components of the formation fluid sample 114 may be determined without the formation fluid sample 114 passing through an internal flow line of the PLT 100. However, other implementations of the PLT 100 within the scope of the present disclosure are not limited to a back-scattering geometry. For example, the axis of the excitation beam may be spatially and/or angularly offset from the axis of the detected light.

One or more of the above-described modules and/or other modules of the PLT 100 may also be operable to measure, sense, and/or detect pressure and/or temperature of fluid flow past the PLT. One or more of the above-described modules and/or other modules of the PLT 100 may also comprise one or more controllers operable to control the functions described above and/or otherwise within the scope of the present disclosure. The one or more controllers may also be operable to communicate and/or work in conjunction with the surface equipment 126. The controller(s) of the PLT and/or the surface equipment 126 may have one or more aspects in common with the processing system described below and shown in FIG. 10.

Figure 2:
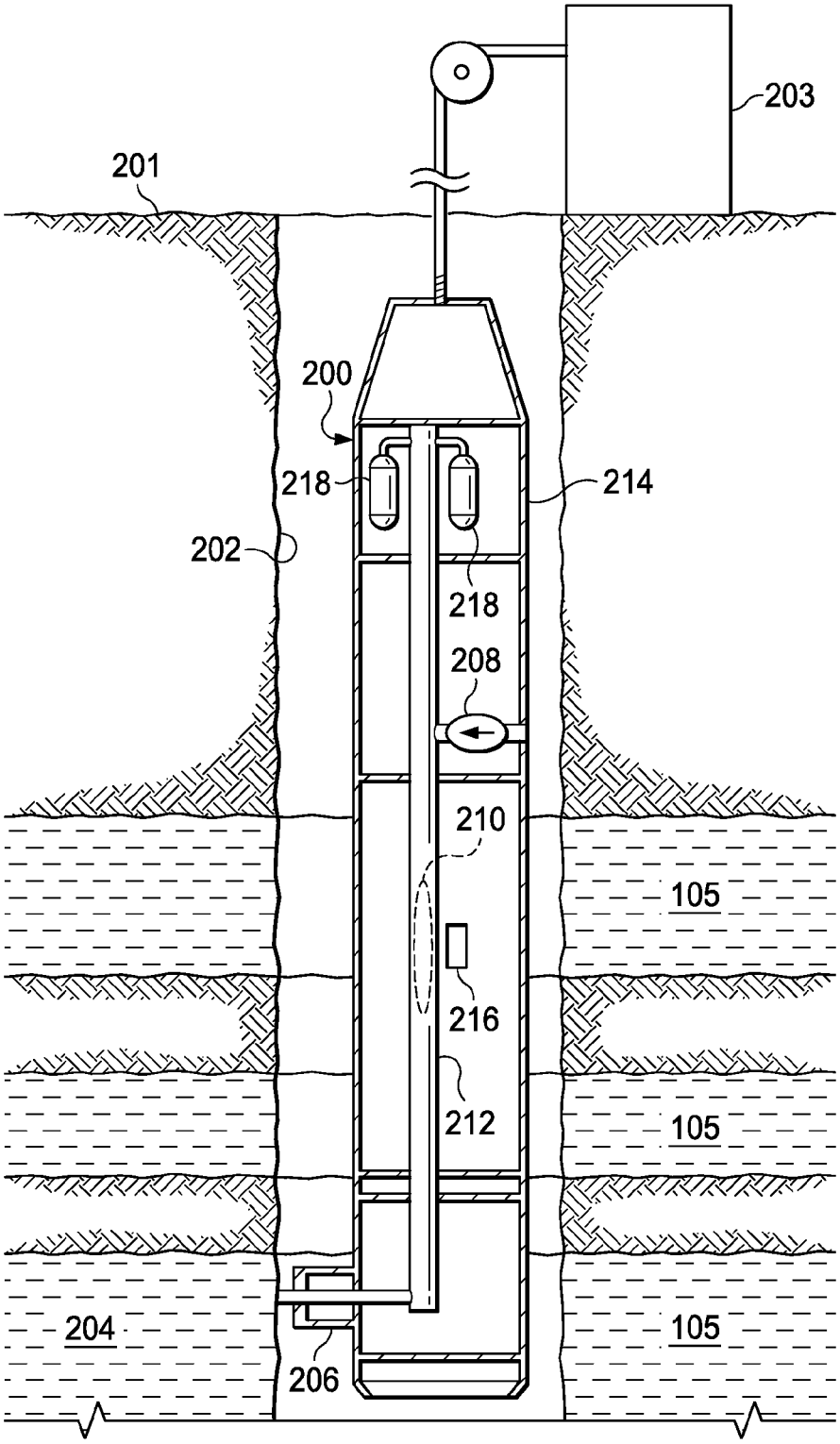
FIG. 2 is a schematic view of at least a portion of apparatus according to one or more aspects of the present disclosure.

FIG. 2 is a schematic view of an implementation of the PLT 100 shown in FIG. 1 according to one or more aspects of the present disclosure, herein designated by reference numeral 200. The PLT 200 may be substantially similar to the PLT 100 shown in FIG. 1 except as described below.

The PLT 200 is suspended within a borehole 202 that traverses a subterranean formation 204. The PLT 200 may be suspended within the borehole 202 via a multi-conductor cable that is spooled on a winch (not shown) and coupled to surface equipment 203 at the surface 201. In contrast to the PLT 100 shown in FIG. 1, in which the formation fluid sample 114 is analyzed outside the PLT 100, the PLT 200 draws the formation fluid sample into the tool and analyzes the sample within the tool. The fluid sample 114 may be a gas, a liquid, or a combination thereof.

The PLT 200 may comprise a formation tester 206 having a probe assembly that may be selectively extendable from the PLT 200 and/or that may be pressed against the sidewall of the borehole 202 by one or more back-up pistons (not shown). The probe assembly is thus configured to fluidly couple to an adjacent formation 204 and draw a formation fluid sample. For example, the formation tester 206 and/or another module, component, or portion of the PLT 200 may comprise a pump 208 operable to pass a formation fluid sample 210 through the probe assembly and into an internal flow line 212 of the PLT 200.

The PLT 200 may also comprise a spectroscopy and/or other optical module 214 that may comprise one or more light sources and/or detectors substantially similar to those described above in reference to the optical module 112 of the PLT 100 shown in FIG. 1. The optical module 214 is in optical communication with the formation fluid sample 210 within the internal flow line 212, such as via a window 216. The window 216 may be substantially similar to the window 118 described above. After the formation fluid sample 210 is analyzed utilizing the optical module 214, the sample may be expelled from the PLT 200 through a port (not shown) or directed to one or more sample chambers 218.

Implementations within the scope of the present disclosure may not be limited to the PLT 100 shown in FIG. 1 and the PLT 200 shown in FIG. 2. For example, an implementation of the PLT 200 shown in FIG. 2 may comprise a window and an optical module operable to analyze formation fluid samples within the borehole and outside the tool. Implementations within the scope of the present disclosure may also be utilized in drilling applications, perhaps as or in conjunction with logging-while-drilling (LWD) apparatus and/or measurement-while-drilling (MWD) apparatus. For example, an LWD implementation within the scope of the present disclosure may comprise sampling-while-drilling apparatus, which may form part of an LWD tool string. In such implementations, a formation fluid sample may be drawn into the downhole tool from the formation and analyzed within the tool, in a manner similar to that of the PLT 200 shown in FIG. 2.

Figure 3:
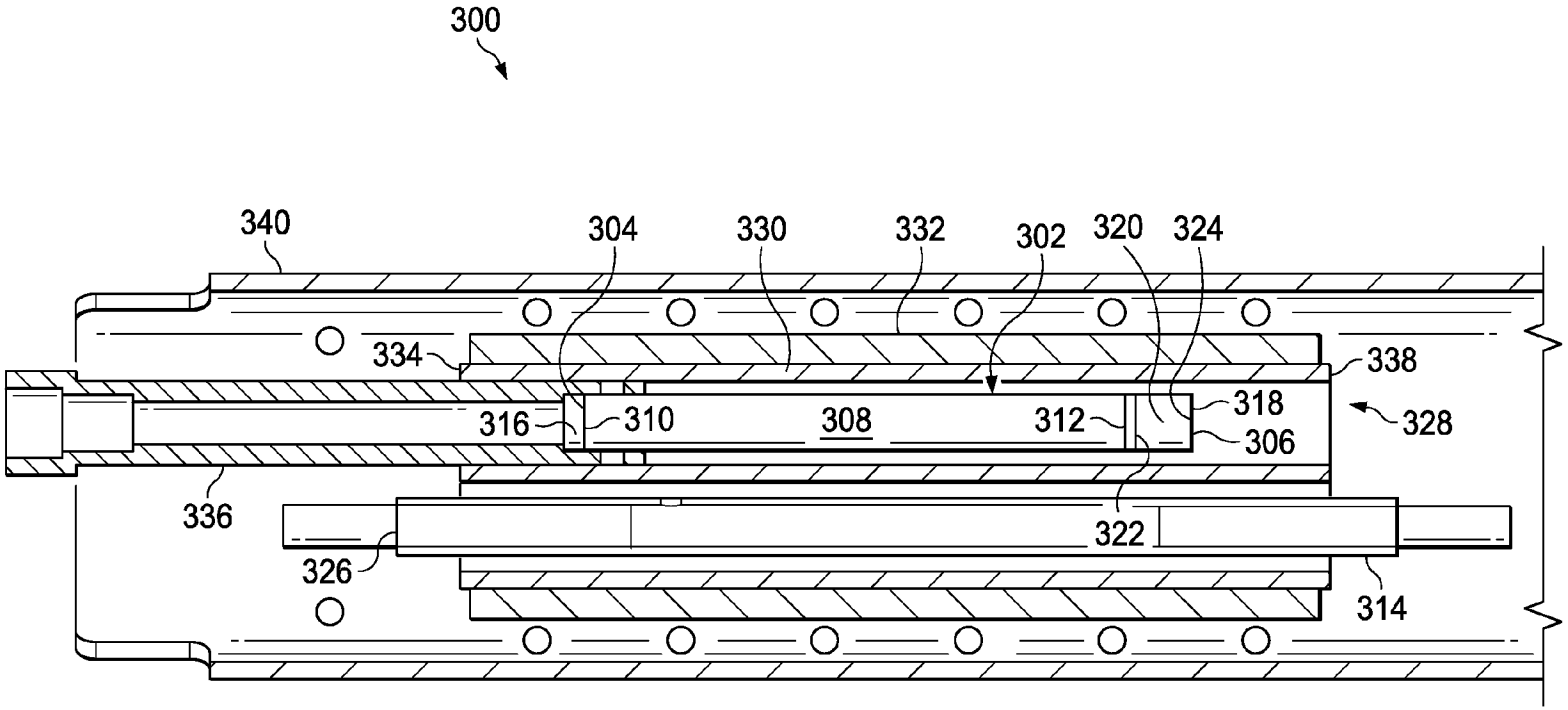
FIG. 3 is a schematic view of at least a portion of apparatus according to one or more aspects of the present disclosure.

FIG. 3 is a schematic view of a laser 300 that may be utilized as one of the above-described light sources according to one or more aspects of the present disclosure. The laser 300 may be operable to provide a light source for a variety of spectroscopy techniques, such as Raman spectroscopy, absorption spectroscopy, and/or laser induced breakdown spectroscopy, among others. However, implementations of the PLT 100 and/or the PLT 200 utilizing a laser other than the laser 300 shown in FIG. 3, and/or other light sources, and whether for Raman and/or other types of spectroscopy, are also within the scope of the present disclosure.

The laser 300 may comprise a monolithic body 302 having a first end 304 and a second end 306. The first end 304 and the second end 306 may be polished. The monolithic body 302 may be rod-shaped, and may comprise a solid-state gain medium 308 having a first end 310 and a second end 312. The solid-state gain medium 308 may comprise a solid-state material, such as a chromium-doped beryllium aluminum oxide crystal (Cr3+:BeAl2O4) ("alexandrite"), a neodymium-doped yttrium aluminum garnet crystal (Nd:Y3Al5O12) ("Nd:YAG"), and/or other materials. The solid-state gain medium 308 may comprise one or more dopant elements, such as neodymium (Nd), ytterbium (Yb), erbium (Er), titanium (Ti), thulium (Tm), and/or other dopants. The solid-state gain medium 308 may provide a photon gain when a pump source 314 creates a population inversion in the solid-state gain medium 308.

A first reflector 316 and a second reflector 318 may be disposed on the first end 304 and the second end 306 of the monolithic body 302, respectively. Thus, the solid-state gain medium 308 may be disposed between the first reflector 316 and the second reflector 318. The first reflector 316 and the second reflector 318 may provide an optical resonator, reflecting light in a closed path.

The first and second reflectors 316 and 318 may be diffusion bonded to the first and second ends 304 and 306, respectively, and/or may be or comprise one or more film coatings. The first reflector 316 may have a reflectivity of about 100 percent (e.g., 95%, 98%, 99%, 99.9%, etc.), and may thus substantially reflect light emitted from the solid-state gain medium 308. The second reflector 318 may have a reflectivity of less than 100 percent (e.g., 80%, 90%, etc.), such as may permit the passage of a laser pulse. The reflective surfaces of the first and second reflectors 316 and 318 may be substantially parallel or curved. For example, the first and second reflectors 316 and 318 may be curved such that they are substantially confocal, having curvature radii that are substantially equal to the distance by which they are separated, or they may be substantially concentric, having curvature radii that are substantially equal to half of the distance by which they are separated.

The monolithic body 302 may comprise a Q-switch 320. The Q-switch 320 may be a passive Q-switch, such as a saturable absorber, for example. A coefficient of thermal expansion of the Q-switch 320 may be substantially equal to a coefficient of thermal expansion of the solid-state gain medium 308. The Q-switch 320 may be implemented utilizing a Cr:YAG crystal. One end 322 of the Q-switch 320 may be diffusion bonded, optical contact bonded, and/or otherwise non-adhesively bonded to the second end 312 of the solid-state gain medium 308. In such implementations, the second reflector 318 may be disposed on an opposing end 324 of the Q-switch 320. In other implementations, the second reflector 318 may be disposed on the second end 312 of the solid-state gain medium 308. The Q-switch 320 may prevent the laser 300 from outputting a laser pulse until a population inversion in the solid-state gain medium 308 reaches a peak and/or otherwise predetermined level.

The pump source 314 may be or comprise a lamp pump source, such as a flash lamp and/or an arc lamp, among others, and/or a light emitting diode, a diode laser, and/or other example sources. The pump source 314 may be adjacent the monolithic body 302. Longitudinal axes of the pump source 314 and the solid-state gain medium 308 may be substantially parallel. The pump source 314 may comprise a glass, quartz, and/or otherwise substantially transparent tube 326 filled with xenon, krypton, and/or other gases. The pump source 314 may be coupled to a capacitor and/or another electrical power source. During operation, an electric current may be delivered to the gas within the tube 326 via the electrical power source to cause the gas to ionize and an arc to form through the gas. The pump source 314 may have an arc length of about 50 mm, or may range between about 40 mm and about 60 mm, although other arc lengths are also within the scope of the present disclosure. The arc may emit a flash of light having a duration of about 100 μs, or ranging between about 10 μs and about 1000 μs, or the arc may emit light continuously. The temperature of the arc may be about 10,000° C., or may range between about 9,000° C. and about 11,000° C., although other temperatures are also within the scope of the present disclosure.

A reflective cavity 328 may substantially enclose the monolithic body 302 and the pump source 314. The reflective cavity 328 may be defined by a glass and/or otherwise substantially transparent cylinder 330 that may be at least partially covered by a diffuse reflector 332, such as may comprise barium sulfate, Teflon®, and/or other materials. The reflective cavity 328 may be an elliptical mirror. A first end 334 of the reflective cavity 328 may comprise an aperture (not shown) adjacent the first end 304 of the monolithic body 302. A mount 336 may extend through the aperture to hold and/or substantially align the monolithic body 302 in the reflective cavity 328. The mount 336 may receive and/or otherwise fix the first end 304 of the monolithic body 302. Another mount may extend through another aperture of the reflective cavity 328, such as to receive and/or otherwise fix the monolithic body 302 along the Q-switch 320.

A second end 338 of the reflective cavity 328 may be at least partially transparent and/or comprise an aperture that may enable the laser 300 to output a laser pulse through the second end 338 of the reflective cavity 328. The reflective cavity 328 and the mount 336 may be disposed in a housing 340. The mount 336 may be coupled to the housing 340. The housing 340 may be disposed within a downhole tool such as, for example, the PLT 100 shown in FIG. 1, the PLT 200 shown in FIG. 2, and/or other downhole tools within the scope of the present disclosure.

The pump source 314 may supply energy to the solid-state gain medium 308 by emitting light. The diffuse reflector 332 of the reflective cavity 328 may reflect the light emitted by the pump source 314. The light may thus excite atoms in the solid-state gain medium 308 until a population inversion occurs in the solid-state gain medium 308 (i.e., a number of electrons in an excited state exceed a number of electrons in a lower energy state). When the population inversion occurs, the solid-state gain medium 308 emits more photons than the solid-state gain medium 308 absorbs. The reflective cavity 328 and the first and second reflectors 316 and 318 amplify the photons emitted by the solid-state gain medium 308, thus causing a laser pulse to be transmitted through the second reflector 318.

The Q-switch 320 may prevent the laser 300 from outputting or transmitting the laser pulse until the population inversion in the solid state gain medium 308 reaches a peak and/or otherwise predetermined level. For example, the Q-switch 320 may be a saturable absorber, and may thus be substantially non-transparent until the population inversion reaches the predetermined level. Once the population inversion reaches the predetermined level, the Q-switch 320 may become at least partially transparent, and the laser pulse may pass through the Q-switch 320 and the second reflector 318.

When the laser 300 is exposed to temperatures between about room temperature and about 200° C., for example, the laser 300 outputs laser pulses having pulse energies substantially independent of the temperature, such as about 8 mJ, 14 mJ, or 22 mJ. For example, from about room temperature to about 200° C., the laser 300 may output laser pulses having pulse energies with a standard deviation within about 10 percent. The deviations may be substantially attributable to random fluctuations that occur during operation regardless of the temperature, such as creation of the arc in the pump source 314, recombination and continuum emission events producing light via the arc, and emitted photon directions from the events, for example. Thus, the laser 300 may output laser pulses having substantially constant pulse energies when exposed to temperatures between about room temperature and about 200° C. The laser 300 may output the laser pulses even when subjected to shocks and/or vibrations.

One or more aspects of the apparatus and/or methods described above may be utilized in conjunction with various methods of production logging interpretation. For example, they may be utilized to determine zone-by-zone production rates of water, oil and/or gas, such as by utilizing a combination of velocity measurements, velocity slip correlations, and holdup (void fraction) measurements. One or more aspects of the apparatus and/or methods described above may also be utilized in conjunction with apparatus and/or methods for measuring the downhole molecular composition of the commingled production of gas. For example, apparatus and/or methods within the scope of the present disclosure may be utilized to assign detected molecules to the production from each of a plurality of zones. Once supplied with the composition of the gas from each zone, the source of rich gas, lean gas, $CO_2$ contaminated gas, and/or $N_2$ contaminated gas (among others) may be determined. This information may then be utilized to manage the well and/or reservoir in the formation, such as to maximize wanted gas production and minimize unwanted gas production. For example, zones identified as being unusually rich in $CO_2$ may not support commercial goals, and may thus be sequestered downhole while lean gas breakthrough in condensate sweep operations may be identified, and injection gas may be redeployed to unswept zones.

For example, in a gas producing well having three zones, a production logging tool (such as the PLT 100 shown in FIG. 1, the PLT 200 shown in FIG. 2, and/or other production logging tools within the scope of the present disclosure) may be operated to measure the total volumetric flow rate $Q_1$, $Q_2$, and $Q_3$ of production fluid within the production tubing at respective depths just above each of the three zones, respectively. These depths will be referred to herein as zone-associated depths. The volumetric inflow from each of the three zones may then determined as set forth below in Equations (1), (2), and (3).

$$q_1=Q_1 \tag{1}$$

$$q_2=Q_2-Q_1 \tag{2}$$

$$q_3=Q_3-Q_2 \tag{3}$$

For the sake of clarity, the volumetric flow rate $Q_n$ within the production tubing may be referred to herein as a production fluid flow rate, and the volumetric flow rate $q_n$ of inflow from a zone into the production tubing may be referred to herein as zonal fluid flow rate. The following description is also presented in the context of the produced formation fluid comprising a binary gas mixture of methane and ethane, although this will seldom be the case in reality.

The PLT may also be operated to obtain a signal proportional to the number density fractions of methane and ethane, measured at each of the zone-associated depths. These fractions will be referred to herein as $f_{1_{methane}}$, $f_{1_{ethane}}$, $f_{2_{methane}}$, $f_{2_{ethane}}$, $f_{3_{methane}}$, and $f_{3_{ethane}}$. Equal moles of gases occupy the same volume at a given pressure (from the ideal gas law), so the production fluid flow rates associated with each zone n may be represented as set forth below in Equation (4).

$$Q_n = \frac{f_{n_{methane}} Q_n + f_{n_{ethane}} Q_n}{f_{n_{methane}} + f_{n_{ethane}}} \tag{4}$$

The left- and right-hand sides of the Equation (4) give the production fluid flow rates of methane and ethane, respectively, as set forth below in Equations (5) and (6).

$$Q_{n_{methane}} = \frac{f_{n_{methane}}}{f_{n_{methane}} + f_{n_{ethane}}} Q_n \tag{5}$$

$$Q_{n_{ethane}} = \frac{f_{n_{ethane}}}{f_{n_{methane}} + f_{n_{ethane}}} Q_n \tag{6}$$

To a first order approximation, the zonal fluid flow rate of methane and ethane may then be determined as set forth below in Equations (7), (8), and (9).

$$q_{n_{methane}}=Q_{n_{methane}}-Q_{n-1_{methane}} \tag{7}$$

$$q_{n_{ethane}}=Q_{n_{ethane}}-Q_{n-1_{ethane}} \tag{8}$$

$$Q_{0_{methane}}=Q_{0_{ethane}}=0 \tag{9}$$

However, according to the ideal gas law, borehole pressure changes from zone to zone will cause corresponding changes in volume. This change in volume might be apparent as a change in flow rate, which might be interpreted as an erroneous entry. Therefore, the PLT may be operated to measure the pressure $P_n$ at each of the zone-associated depths, which may be normalized by a factor $P_n/P_{ref}$. Changes in temperature and compression factor (departures from the ideal gas law) may similarly be accounted for by factors $T_{ref}/T_n$ and $z_{ref}/z_n$. The reference conditions may be standard conditions, although a downhole reference or another reference may also be utilized. Applying such normalization factors to Equations (5) and (6) results in Equations (10) and (11) set forth below.

$$Q_{n_{methane}} = \frac{f_{n_{methane}}}{f_{n_{methane}} + f_{n_{ethane}}} Q_n \frac{P_n T_{ref} z_{ref}}{P_{ref} T_n z_n} \tag{10}$$

$$Q_{n_{ethane}} = \frac{f_{n_{ethane}}}{f_{n_{methane}} + f_{n_{ethane}}} Q_n \frac{P_n T_{ref} z_{ref}}{P_{ref} T_n z_n} \tag{11}$$

Assuming the number of compositional components is y (so that, in the above example, y=2), and $y_x$ is the $x^{th}$ compositional component (where $y_1$ is methane and $y_2$ is ethane in the above example), Equations (10) and (11) may be generalized as set forth below in Equation (12).

$$Q_{n_x} = \frac{f_{n_x}}{f_{n_1} + f_{n_2} + f_{n_3} + \ldots + f_{n_y}} Q_n \frac{P_n T_{ref} z_{ref}}{P_{ref} T_n z_n} \tag{12}$$

Thus, the zonal contribution of the $n^{th}$ zone of the $x^{th}$ compositional component will be as set forth below in Equation (13).

$$q_{n_x}=Q_{n_x}-Q_{n-1_x} \tag{13}$$

where $Q_{0_x}$ is zero.

In some implementations within the scope of the present disclosure, the Raman spectrometer and/or other sensor of the optical module of the PLT (such as the optical module 112 of the PLT 100 shown in FIG. 1 and/or the optical module 214 of the PLT 200 shown in FIG. 2) may sense compositional component proportions in terms of mass fractions. In such implementations, a relative molecular mass term $M_r$ may be included in the above technique. For example, if $w_{n_{methane}}$ and $w_{n_{ethane}}$ fractions represent the respective mass actions of methane and ethane associated with zone n, Equation (4) may be modified as set forth below in Equation (14).

$$Q_n = \frac{w_{n_{methane}} Q_n + w_{n_{ethane}} Q_n \frac{M_{r_{methane}}}{M_{r_{ethane}}}}{w_{n_{methane}} + w_{n_{ethane}} \frac{M_{r_{methane}}}{M_{r_{ethane}}}} \tag{14}$$

In some implementations within the scope of the present disclosure, the Raman spectrometer and/or other compositional component sensor may be unable to detect and quantify some of the compositional components present in the production fluid flow. The technique described above may, in such instances, proportionally assign the missing proportions to those that have been detected, which may thus preserve a valid ratio of the detected components.

As described above, the compositional component proportions may be determined via operation of the PLT's Raman spectroscopy sensor(s). However, sensors such as those that may be utilized for infrared absorption spectroscopy, gas chromatography, and/or nuclear magnetic resonance, among others, may be similarly and/or simultaneously utilized to return a signal proportional to or otherwise representative of the fraction of each compositional component in the comingled production fluid flow.

As also described above, this technique is not limited to the gases methane and ethane utilized for illustration in the equations above, and may be applied to other compositional components, such as propane, butane, pentane, hexane, heptane, octane, nonane, decane, carbon dioxide, nitrogen, and/or hydrogen sulfide, among others. Moreover, this technique is not limited to gases, and may be applied or readily adapted for utilization with liquid fractions containing hydrocarbons, such as n-alkanes and/or other saturates, as well as benzene, m-xylene, and/or other aromatics, among other hydrocarbons. In such implementations, the liquid fraction may also comprise water, or a multiphase mixture containing gas, liquid hydrocarbon, and/or water.

Table 1 set forth below presents an example Raman spectrum of a natural gas mixture comprising methane, ethane, propane, and $CO_2$.

TABLE 1

Example Raman Spectrum

| Compositional Component | Wavenumber ($cm^{-1}$) | Raman Intensity |
|---|---|---|
| Methane | 2910 | ~115,000 |
| $CO_2$ | 1383 | ~5,200 |
| Ethane | 993 | ~10,600 |
| Propane | 869 | ~3,500 |

The units for the Raman intensity are arbitrary, such as a count of photons, among other examples.

The Raman signal from each molecule is linearly proportional to the density of the compositional component in the mixture. Analysis of the sample composition of the comingled gas is based on linear superposition in which the Raman spectrum of the mixture is equal to the weighted sum of the individual species in the mixture. A calibration procedure may establish the relationship between the measured response of an individual detector channel and the concentration of a particular compositional component in the mixture.

Raman spectrometry utilizes a high-brightness, narrow-band laser source, such as that shown in FIG. 3. Raman spectrometry may be utilized in some implementations within the present disclosure where, for example, an internal flowline may not be available for spectrometry. Raman photons are scattered isotropically, therefore the photons can be collected in a back-scattering geometry along the same axis as the excitation beam. Raman spectrometry may also be utilized in implementations without prior phase-separation of gas and water, because the water Raman band does not interfere with the Raman bands of any of the listed mixture species. Nonetheless, implementations within the scope of the present disclosure may instead (or additionally) utilize an infrared spectrometer, such as to perform an absorption measurement that, through application of Beer's law, may be utilized to determine the compositional component density/proportions.

Figure 4:
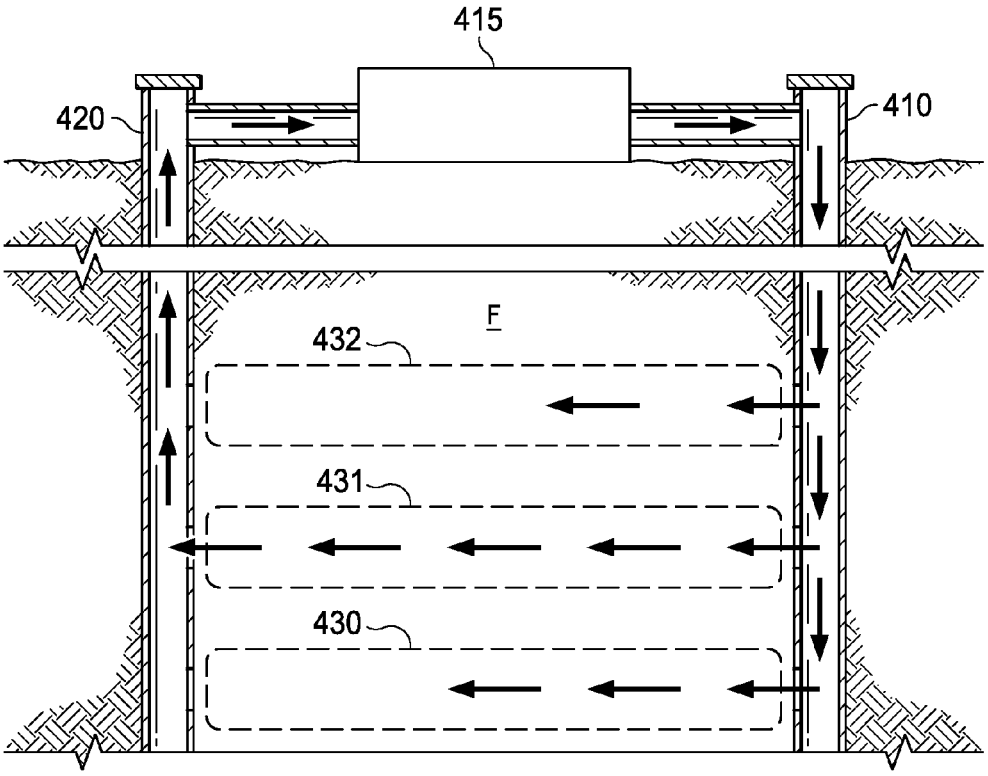
FIG. 4 is a schematic view of at least a portion of apparatus according to one or more aspects of the present disclosure.

There are many applications within the scope of the present disclosure that may utilize the techniques described above and/or the results thereof. Referring to FIG. 4, for example, a lean gas substantially comprising methane, ethane, nitrogen, carbon dioxide, and/or another sweeping fluid may be pumped into an injector well 410 by surface equipment 415 to sweep gas condensate from zones 430-432 of a formation F to a producing well 420. In one of the zones 431, the sweeping fluid from the injector well 410 may break through into the producing well 420. The breakthrough may be determined utilizing the surface equipment 415. PLT analysis according to one or more aspects of the present disclosure may be utilized to measure the ratios of compositional components at depths associated with each of the zones 430-432 to determine that the breakthrough has occurred in the one of the zones, depicted as zone 431 in FIG. 4. The zone 431 may then be shut-in by cementing and/or other means. As a result of the shut in, less compressed gas, water, and/or other sweeping agent may return to the surface through the production well 420, and condensate swept from the other zones 430 and 432 may thus be increased.

Figure 5:
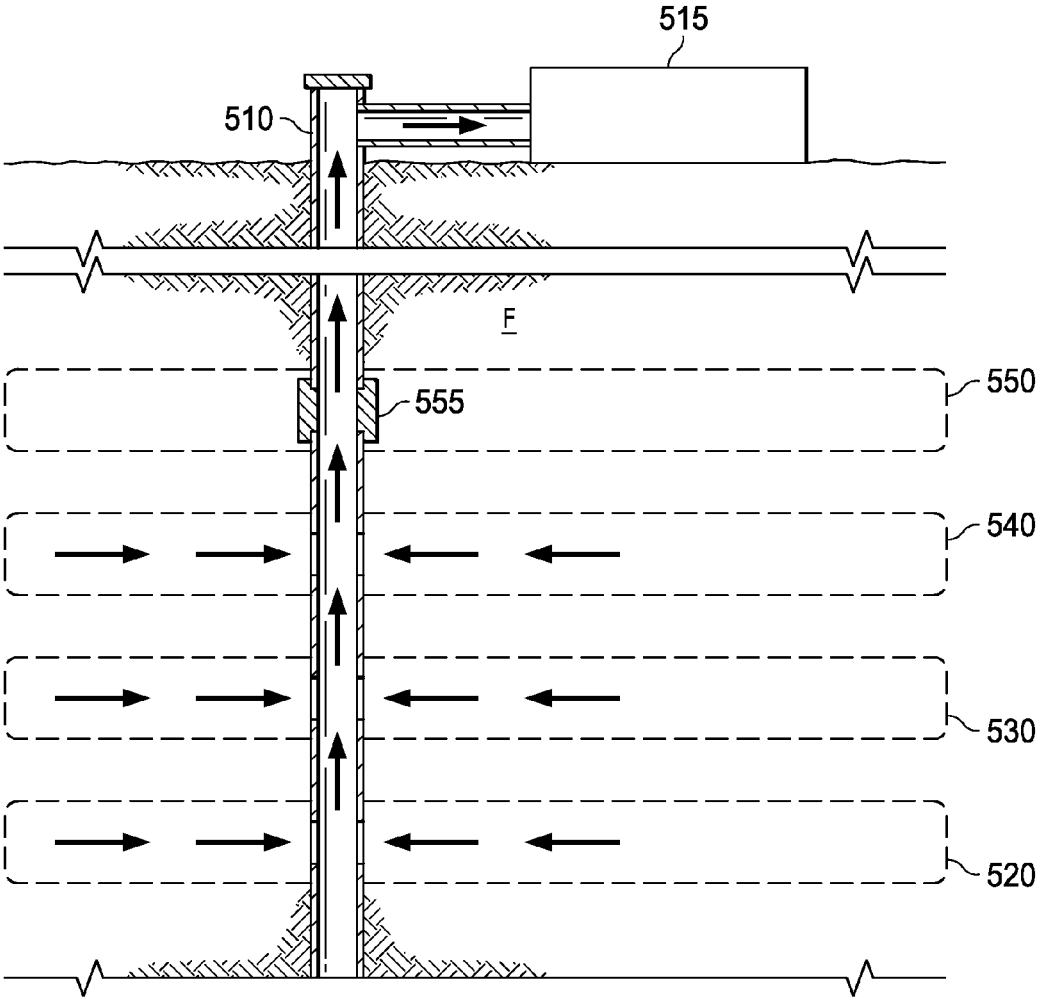
FIG. 5 is a schematic view of at least a portion of apparatus according to one or more aspects of the present disclosure.

FIG. 5 provides another example application that may utilize one or more aspects of techniques within the scope of the present disclosure. In FIG. 5, a well 510 is depicted extending through the formation F, including intersecting sand bodies and/or other zones 520, 530, 540, and 550 having variable $CO_2$ and/or $H_2S$ content. The net caloric content of the comingled production fluid flow within the well 510 may be lowered by $CO_2$ content, and surface equipment 515 may have a maximum $H_2S$ amount that can be safely handled. PLT analysis according to one or more aspects of the present disclosure may be utilized to determine the $CO_2$ and/or $H_2S$ proportion of the zonal fluid flow from each of the sand bodies and/or zones 520, 530, 540, and 550. For example, operation of a PLT within the scope of the present disclosure may determine that the $CO_2$ and/or $H_2S$ proportion of the sand bodies and/or zones 520, 530, and 540 may be less than 10% or some other predetermined threshold, while the $CO_2$ and/or $H_2S$ proportion of the sand body and/or zone 550 may be determined to be greater than 20% or some other predetermined threshold. Accordingly, the sand body and/or zone 550 may then be shut-in by cementing and/or other means 555. As a result, more $CO_2$ and/or $H_2S$ may be sequestered downhole instead of being separated and/or otherwise handled by the surface equipment 515.

Figure 6:
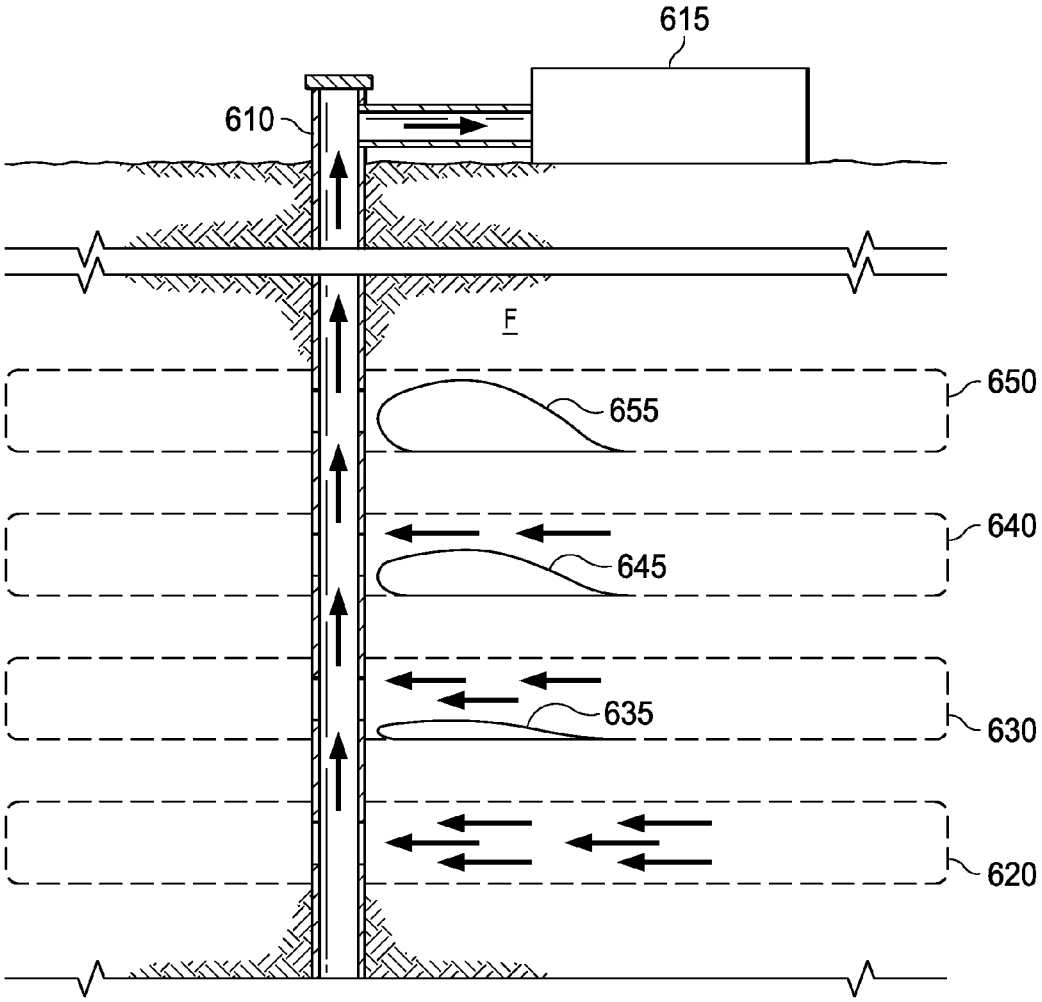
FIG. 6 is a schematic view of at least a portion of apparatus according to one or more aspects of the present disclosure.

FIG. 6 provides another example application that may utilize one or more aspects of techniques within the scope of the present disclosure. In FIG. 6, a well 610 is depicted intersecting zones 620, 630, 640, and 650 of the formation F. The upper zone 650 is depicted as including a gas condensate bank 655, and the zones 640 and 630 similarly include respective gas condensate banks 645 and 635. However, the condensate banks 635, 645, and 655 are of varying size. The condensate banks 635, 645, and 655 may occur if the corresponding zones 630, 640, and 650 become retrograde, such that reducing the drawdown pressure (the difference between formation pressure and pressure in the borehole and/or production tubing) results in an increase in liquid production, as opposed to zone 620 where the reduction in drawdown pressure results in an increase in gas production. In the retrograde zones 630, 640, and 650, the liquid does not flow through the formation F as quickly as the gas flows through the zone 620, which results in an accumulation of condensate choking the flow within the zone. Retrograde zones may present challenges in the context of modeling and real-time reservoir management.

However, one or more aspects of the present disclosure may be utilized in such scenarios. For example, the PLT may be positioned adjacent the condensate bank 635, 645, or 655, and the drawdown pressure may be varied while utilizing the PLT to monitor the resulting variations in compositional component proportions of the associated zonal fluid flow. Variation of the drawdown pressure may be accomplished via operation of one or more chokes and/or other components of the associated surface equipment 615. Consequently, the onset and/or degree of condensate banking may be measured on a zone-by-zone basis. This information may also be utilized to optimize the drawdown rate to, for example, maximize efficiencies of the system and/or minimize the production of unwanted gas and/or certain compositional components.

Figure 7:
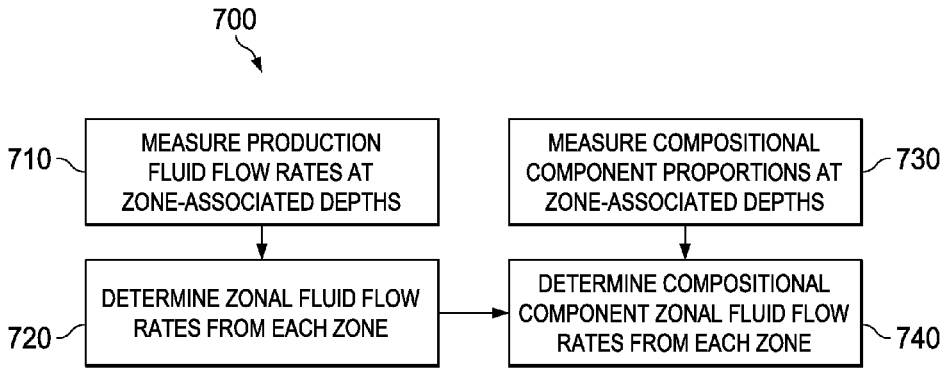
FIG. 7 is a flow-chart diagram of at least a portion of a method according to one or more aspects of the present disclosure.

FIG. 7 is a flow-chart diagram of at least a portion of a method 700 according to one or more aspects of the present disclosure. The method 700 comprises measuring (710) a volumetric flow rate of production fluid flow at each of a plurality of depths associated with a corresponding one of a plurality of zones of a formation. Such measuring may be performed by operation of a PLT, such as the PLT 100 shown in FIG. 1, the PLT 200 shown in FIG. 2, and/or another PLT within the scope of the present disclosure. The volumetric flow rate of the zonal fluid flow from each of the zones is then determined (720) based on the volumetric flow rates of the production fluid flow measured at each of the zone-associated depths. Such determination (720) may be according to the equations set forth above.

The method 700 also comprises measuring (730) proportions of compositional components of the production fluid flow at each of the zone-associated depths. Such measurement (730) may be performed by the same PLT utilized to measure the production fluid flow rates at each of the zone-associated depths, perhaps simultaneously, such as during a continuous or other conveyance of the PLT down (or up) the well. The measurements (710 and 730) may also be performed during different logging runs with potentially different downhole tools in the tool string. The compositional component proportions measured (730) at each of the zone-associated depths may be returned from the compositional component sensor of the PLT based on volume, number density, mass fractions, and/or otherwise. The volumetric flow rate of each compositional component of the zonal fluid flow from each of the zones may then be determined (740) based on the determined volumetric flow rate of the zonal fluid flow from each of the zones and the proportions of compositional components of the production fluid flow measured at each of the zone-associated depths. Such determination (740) may be according to the equations set forth above.

Figure 8:
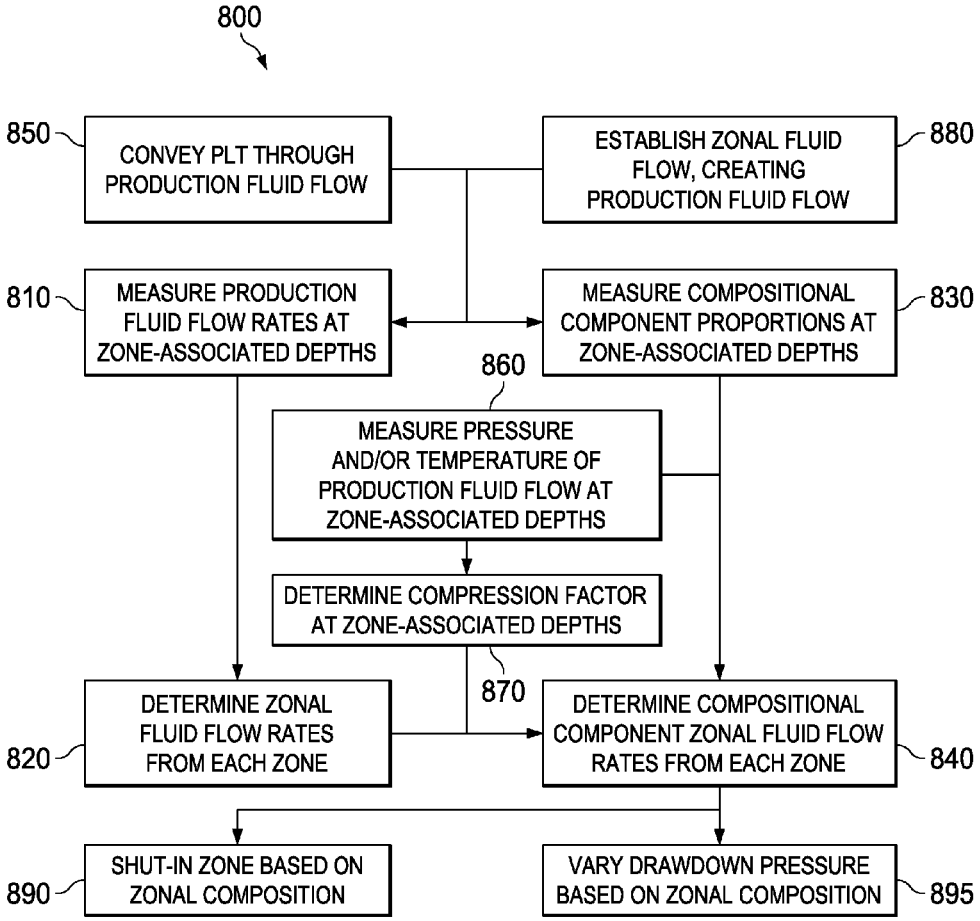
FIG. 8 is a flow-chart diagram of at least a portion of a method according to one or more aspects of the present disclosure.

FIG. 8 is a flow-chart diagram of at least a portion of a method 800 according to one or more aspects of the present disclosure. The method 800 may be substantially similar to, or have one or more aspects in common with, the method 700 shown in FIG. 7. For example, the method 800 comprises measuring (810) a volumetric flow rate of production fluid flow at each of a plurality of depths associated with a corresponding one of a plurality of zones of a formation. Such measuring (810) may be performed by operation of a PLT, such as the PLT 100 shown in FIG. 1, the PLT 200 shown in FIG. 2, and/or another PLT within the scope of the present disclosure. The volumetric flow rate of the zonal fluid flow from each of the zones is then determined (820) based on the volumetric flow rates of the production fluid flow measured (810) at each of the zone-associated depths. Such determination (820) may be according to the equations set forth above.

The method 800 also comprises measuring (830) proportions of compositional components of the production fluid flow at each of the zone-associated depths. Such measurement (830) may be performed by the same PLT utilized to measure the production fluid flow rates at each of the zone-associated depths, perhaps simultaneously, such as during a substantially continuous or other conveyance of the PLT down (or up) the well. The measurements (810 and 830) may also be performed during different logging runs with potentially different downhole tools in the tool string. The compositional component proportions measured (830) at each of the zone-associated depths may be returned from the compositional component sensor of the PLT based on volume, number density, mass fractions, and/or otherwise.

The volumetric flow rate of each compositional component of the zonal fluid flow from each of the zones may then be determined (840) based on the determined volumetric flow rate of the zonal fluid flow from each of the zones and the proportions of compositional components of the production fluid flow measured at each of the zone-associated depths. Such determination (840) may be according to the equations set forth above.

However, the method 800 may further comprise conveying (850) the PLT within casing and/or production tubing through which the production fluid flow is established by the zonal fluid flow into the casing and/or production tubing. Such conveyance may be via any means and remain within the scope of the present disclosure, such as slickline, wireline, coiled tubing, pipe, and/or other conveyance means.

The method 800 may further comprise operating the PLT to measure (860) pressure and/or temperature of the production fluid flow at each of the zone-associated depths. This information may be utilized when the compositional component zonal fluid flow rates are determined (840) for each zone. For example, the method 800 may further comprise determining a compression factor of the production fluid flow at each of the zone-associated depths based on the pressure and temperature of the production fluid flow measured at each of the zone-associated depths. Determining (840) the volumetric flow rate of each compositional component of the zonal fluid from each of the zones may then be further based on the pressure and temperature of the production fluid flow measured (860) at each of the zone-associated depths and the compression factor of the production fluid determined (870) at each of the zone-associated depths. Again, such determination (840) may be according to the equations set forth above.

Determining (820) the volumetric flow rate of the zonal fluid flow from each of the zones based on the volumetric flow rates of the production fluid flow measured at each of the zone-associated depths may comprise comparing the volumetric flow rates of the production fluid flow measured at neighboring ones of the zone-associated depths. Again, such determination (820) may be according to the equations set forth above.

The method 800 may further comprise operating (880) surface equipment to establish the zonal fluid flow into the production fluid flow. For example, such operation (880) may entail operation of one or more chokes and/or other components of the surface equipment, such as the surface equipment 126 shown in FIG. 1, the surface equipment 203 shown in FIG. 2, the surface equipment 415 shown in FIG. 4, the surface equipment 515 shown in FIG. 5, and/or the surface equipment 615 shown in FIG. 6.

The method 800 may further comprise varying (890) a drawdown pressure based on the determined volumetric flow rate of at least one of the compositional components of the zonal fluid flow from at least one of the zones. Such variation (890) may be utilized to optimize production from one or more of the zones, and may entail operation of one or more chokes and/or other components of the surface equipment, such as the surface equipment 126 shown in FIG. 1, the surface equipment 203 shown in FIG. 2, the surface equipment 415 shown in FIG. 4, the surface equipment 515 shown in FIG. 5, and/or the surface equipment 615 shown in FIG. 6.

Figure 9:
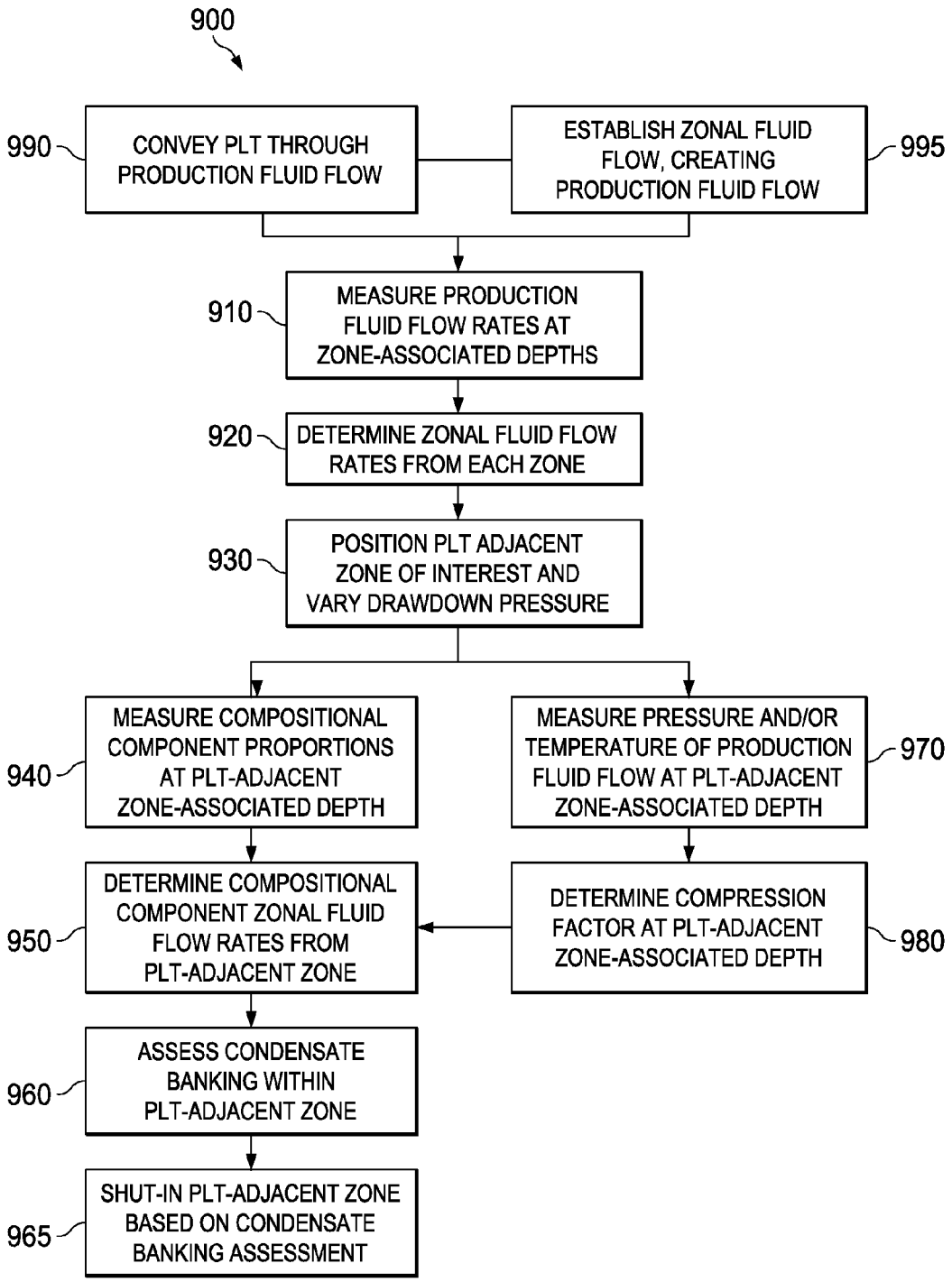
FIG. 9 is a flow-chart diagram of at least a portion of a method according to one or more aspects of the present disclosure.

FIG. 9 is a flow-chart diagram of at least a portion of a method 900 according to one or more aspects of the present disclosure. The method 900 may be substantially similar to, or have one or more aspects in common with, the method 700 shown in FIG. 7 and/or the method 800 shown in FIG. 8. For example, the method 900 comprises measuring (910) a volumetric flow rate of production fluid flow at each of a plurality of depths associated with a corresponding one of a plurality zones of a formation. Such measuring (910) may be performed by operation of a PLT, such as the PLT 100 shown in FIG. 1, the PLT 200 shown in FIG. 2, and/or another PLT within the scope of the present disclosure. The volumetric flow rate of the zonal fluid flow from each of the zones is then determined (920) based on the volumetric flow rates of the production fluid flow measured (910) at each of the zone-associated depths. Such determination (920) may be according to the equations set forth above.

The method 900 also comprises positioning the PLT adjacent a zone of interest and then varying (930) drawdown pressure. The zone of interest may be a retrograde zone and/or a zone suspected to have developed excessive condensate banking. While the drawdown pressure is varied (930), the PLT may be operated to measure (940) proportions of compositional components of the production fluid flow at the PLT-adjacent zone-associated depth and determine (950) a volumetric flow rate of each compositional component of the zonal fluid flow from the PLT-adjacent zone. Such determination (950) may be based on the determination (920) of the volumetric flow rate of the zonal fluid flow from the PLT-adjacent zone and the proportions of compositional components of the production fluid flow measured (940) at the PLT-adjacent zone-associated depth, such as according to the equations set forth above. Condensate banking within the PLT-adjacent zone may then be assessed (960) based on the determined (950) volumetric flow rate of one or more compositional components of the zonal fluid flow from the PLT-adjacent zone. The method 900 may further comprise shutting-in (965) the PLT-adjacent zone based on the determination (950) of the volumetric flow rate of at least one of the compositional components of the zonal fluid flow from the PLT-adjacent zone and/or the assessment (960) of condensate banking within the PLT-adjacent zone.

The measurement (940) of the proportions of the compositional components of the production fluid flow at PLT-adjacent zone-associated depth may be performed by the same PLT (after positioning (930)) utilized to measure (910) the production fluid flow rates at each of the zone-associated depths. The compositional component proportions measured (940) at the PLT-adjacent zone-associated depth may be returned from the compositional component sensor of the PLT based on volume, number density, mass fractions, and/or otherwise.

The variation (930) of the drawdown pressure may comprise operating surface equipment in fluid communication with the production tubing. For example, such operation may entail operation of one or more chokes and/or other components of the surface equipment, such as the surface equipment 126 shown in FIG. 1, the surface equipment 203 shown in FIG. 2, the surface equipment 415 shown in FIG. 4, the surface equipment 515 shown in FIG. 5, and/or the surface equipment 615 shown in FIG. 6.

The method 900 may further comprise measuring (970) pressure and temperature of the production fluid flow at the PLT-adjacent zone-associated depth, such as via operation of the PLT. A compression factor of the production fluid flow at the PLT-adjacent zone-associated depth may then be determined (980) based on the pressure and temperature of the production fluid flow measured (970) at the PLT-adjacent zone-associated depth. The determination (950) of the volumetric flow rate of each compositional component of the zonal fluid flow from the PLT-adjacent zone may thus be further based on the pressure and temperature of the production fluid flow measured (970) at the PLT-adjacent zone-associated depth and the compression factor of the production fluid determined (980) at the PLT-adjacent zone-associated depth.

The method 900 may further comprise conveying (990) the PLT within the casing and/or production tubing through which the production fluid flow is established by zonal fluid flow. Such conveyance (990) may be via any means and yet remain within the scope of the present disclosure, such as slickline, wireline, coiled tubing, pipe, and/or other conveyance means.

The method 900 may further comprise operating (995) surface equipment to establish the zonal fluid flow into the production fluid flow. For example, such operation (995) may entail operation of one or more chokes and/or other components of the surface equipment, such as the surface equipment 126 shown in FIG. 1, the surface equipment 203 shown in FIG. 2, the surface equipment 415 shown in FIG. 4, the surface equipment 515 shown in FIG. 5, and/or the surface equipment 615 shown in FIG. 6.

Figure 10:
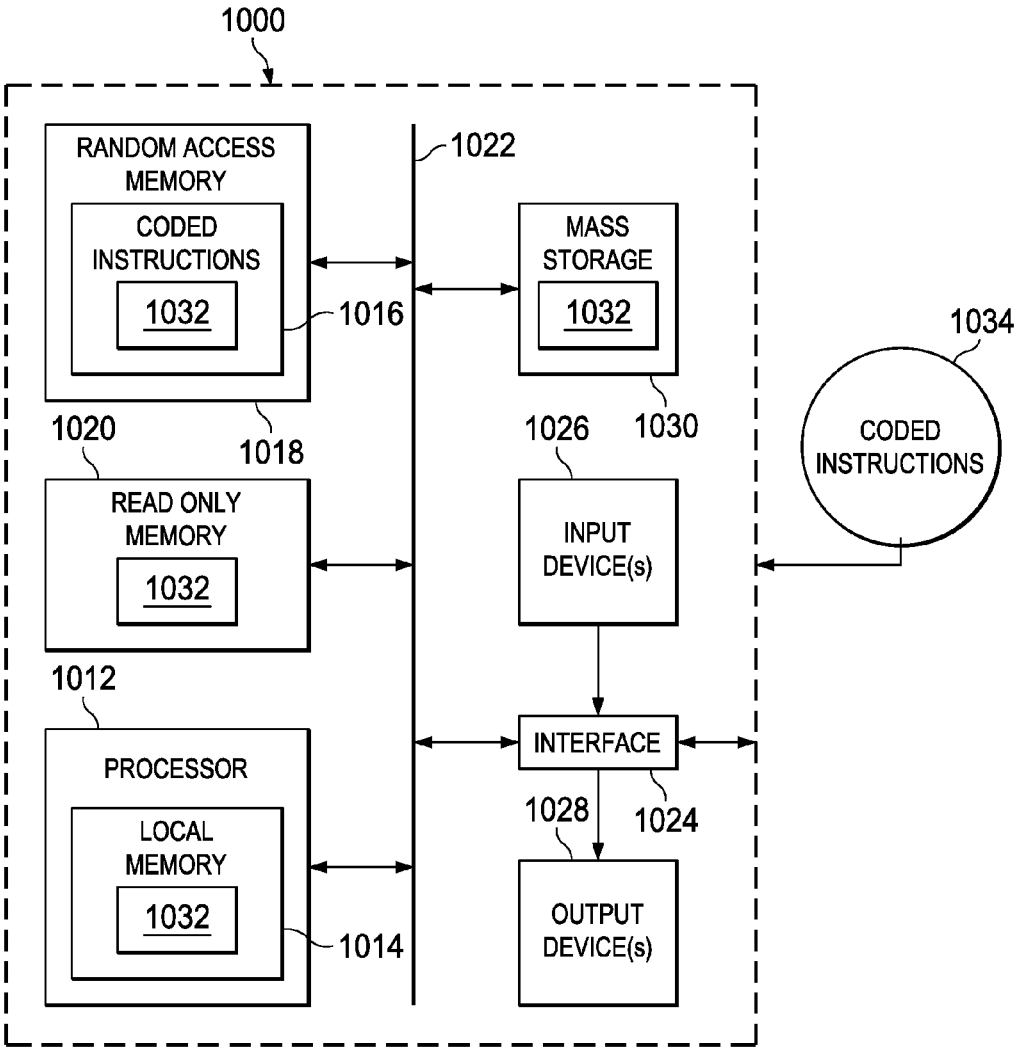
FIG. 10 is a block diagram of at least a portion of apparatus according to one or more aspects of the present disclosure.

FIG. 10 is a block diagram of an example processing system 1000 that may execute example machine-readable instructions used to implement one or more of the methods and/or processes described herein, and/or to implement the example downhole tools described herein. The processing system 1000 may be or comprise, for example, one or more processors, one or more controllers, one or more special-purpose computing devices, one or more servers, one or more personal computers, one or more personal digital assistant (PDA) devices, one or more smartphones, one or more internet appliances, and/or any other type(s) of computing device(s). One or more of the components of the example processing system 1000 may be implemented within the PLT 100 and/or surface equipment 126 shown in FIG. 1, and/or the PLT 200 and/or surface equipment 203 shown in FIG. 2.

The system 1000 comprises a processor 1012 such as, for example, a general-purpose programmable processor. The processor 1012 includes a local memory 1014, and executes coded instructions 1032 present in the local memory 1014 and/or in another memory device. The processor 1012 may execute, among other things, machine-readable instructions to implement the methods and/or processes described herein. The processor 1012 may be, comprise or be implemented by any type of processing unit, such as one or more Intel® microprocessors, one or more microcontrollers from the ARM® and/or picoPower® families of microcontrollers, one or more embedded soft/hard processors in one or more FPGAs, etc. Of course, other processors from other families are also appropriate.

The processor 1012 is in communication with a main memory including a volatile (e.g., random access) memory 1018 and a non-volatile (e.g., read only) memory 1020 via a bus 1022. The volatile memory 1018 may be, comprise or be implemented by static random access memory (SRAM), synchronous dynamic random access memory (SDRAM), dynamic random access memory (DRAM), RAMBUS dynamic random access memory (RDRAM) and/or any other type of random access memory device. The non-volatile memory 1020 may be, comprise or be implemented by flash memory and/or any other desired type of memory device. One or more memory controllers (not shown) may control access to the main memory 1018 and/or 1020.

The processing system 1000 also includes an interface circuit 1024. The interface circuit 1024 may be, comprise or be implemented by any type of interface standard, such as an Ethernet interface, a universal serial bus (USB) and/or a third generation input/output (3GIO) interface, among others.

One or more input devices 1026 are connected to the interface circuit 1024. The input device(s) 1026 permit a user to enter data and commands into the processor 1012. The input device(s) may be, comprise or be implemented by, for example, a keyboard, a mouse, a touchscreen, a track-pad, a trackball, an isopoint and/or a voice recognition system, among others.

One or more output devices 1028 are also connected to the interface circuit 1024. The output devices 1028 may be, comprise or be implemented by, for example, display devices (e.g., a liquid crystal display or cathode ray tube display (CRT), among others), printers and/or speakers, among others. Thus, the interface circuit 1024 may also comprise a graphics driver card.

The interface circuit 1024 also includes a communication device such as a modem or network interface card to facilitate exchange of data with external computers via a network (e.g., Ethernet connection, digital subscriber line (DSL), telephone line, coaxial cable, cellular telephone system, satellite, etc.).

The processing system 1000 also includes one or more mass storage devices 1030 for storing machine-readable instructions and data. Examples of such mass storage devices 1030 include floppy disk drives, hard drive disks, compact disk drives and digital versatile disk (DVD) drives, among others.

The coded instructions 1032 may be stored in the mass storage device 1030, the volatile memory 1018, the non-volatile memory 1020, the local memory 1014 and/or on a removable storage medium, such as a CD or DVD 1034.

As an alternative to implementing the methods and/or apparatus described herein in a system such as the processing system of FIG. 10, the methods and or apparatus described herein may be embedded in a structure such as a processor and/or an ASIC (application specific integrated circuit).

In view of the entirety of the present disclosure, including the figures, a person having ordinary skill in the art will recognize that the present disclosure introduces a method comprising: conveying a tool within a tubing comprising a zonal fluid flow; operating the tool to measure a flow rate of the fluid flow at each of a plurality of depths, wherein each of the plurality of depths is associated with a corresponding zone of the zonal fluid flow; determining a flow rate of the zonal fluid flow from each of the zones based on the flow rates of the fluid flow measured at each of the zone-associated depths; operating the tool to measure proportions of compositional components of the fluid flow at each of the zone-associated depths; and determining a flow rate of each compositional component of the zonal fluid flow from each of the zones based on: the determined flow rate of the zonal fluid flow from each of the zones; and the proportions of compositional components of the production fluid flow measured at each of the zone-associated depths.

The method may further comprise: operating the PLT to measure pressure and temperature of the production fluid flow at each of the zone-associated depths; and determining a compression factor of the production fluid flow at each of the zone-associated depths based on the pressure and temperature of the production fluid flow measured at each of the zone-associated depths; wherein determining the flow rate of each compositional component of the zonal fluid flow from each of the zones may be further based on: the pressure and temperature of the production fluid flow measured at each of the zone-associated depths; and the determined compression factor of the production fluid at each of the zone-associated depths.

Operating the PLT to measure proportions of the compositional components of the production fluid flow at each of the zone-associated depths may comprise operating the PLT to measure volumetric proportions of the compositional components of the production fluid flow at each of the zone-associated depths.

Operating the PLT to measure proportions of the compositional components of the production fluid flow at each of the zone-associated depths may comprise operating the PLT to measure mass proportions of the compositional components of the production fluid flow at each of the zone-associated depths.

Determining the flow rate of the zonal fluid flow from each of the zones based on the flow rates of the production fluid flow measured at each of the zone-associated depths may comprise comparing the flow rates of the production fluid flow measured at neighboring ones of the zone-associated depths.

The method may further comprise operating surface equipment in fluid communication with the production tubing to establish the zonal fluid flow into the production tubing. Operating the surface equipment may comprise operating a choke.

The method may further comprise shutting-in at least one of the zones based on the determined flow rate of at least one of the compositional components of the zonal fluid flow from that at least one zone.

The method may further comprise varying a drawdown pressure based on the determined flow rate of at least one of the compositional components of the zonal fluid flow from at least one of the zones. Varying the drawdown pressure may comprise operating surface equipment in fluid communication with the production tubing. Operating the surface equipment may comprise operating a choke.

The present disclosure also introduces a method comprising: conveying a production logging tool (PLT) within production tubing containing production fluid flow established by zonal fluid flow into the production tubing from zones of a subterranean formation through which the production tubing extends; operating the PLT to measure a flow rate of the production fluid flow at each of a plurality of depths associated with a corresponding one of the zones; determining a flow rate of the zonal fluid flow from each of the zones based on the flow rates of the production fluid flow measured at each of the zone-associated depths; positioning the PLT adjacent one of the zones and then varying a drawdown pressure while: operating the PLT to measure proportions of compositional components of the production fluid flow at the PLT-adjacent zone-associated depth; and determining a flow rate of each compositional component of the zonal fluid flow from the PLT-adjacent zone based on: the determined flow rate of the zonal fluid flow from the PLT-adjacent zone; and the proportions of compositional components of the production fluid flow measured at the PLT-adjacent zone-associated depth; and assessing condensate banking within the PLT-adjacent zone based on the determined flow rate of each compositional component of the zonal fluid flow from the PLT-adjacent zone.

The method may further comprise: operating the PLT to measure pressure and temperature of the production fluid flow at the PLT-adjacent zone-associated depth; and determining a compression factor of the production fluid flow at the PLT-adjacent zone-associated depth based on the pressure and temperature of the production fluid flow measured at the PLT-adjacent zone-associated depth; wherein determining the flow rate of each compositional component of the zonal fluid flow from the PLT-adjacent zone may be further based on: the pressure and temperature of the production fluid flow measured at the PLT-adjacent zone-associated depth; and the determined compression factor of the production fluid at the PLT-adjacent zone-associated depth.

Operating the PLT to measure proportions of the compositional components of the production fluid flow at the PLT-adjacent zone-associated depth may comprise operating the PLT to measure volumetric proportions of the compositional components of the production fluid flow at the PLT-adjacent zone-associated depth.

Operating the PLT to measure proportions of the compositional components of the production fluid flow at the PLT-adjacent zone-associated depth may comprise operating the PLT to measure mass proportions of the compositional components of the production fluid flow at the PLT-adjacent zone-associated depth.

The method may further comprise shutting-in the PLT-adjacent zone based on the determined flow rate of at least one of the compositional components of the zonal fluid flow from the PLT-adjacent zone.

Varying the drawdown pressure may comprise operating surface equipment in fluid communication with the production tubing. Operating the surface equipment may comprise operating a choke.

The present disclosure also introduces an apparatus comprising: a production logging tool (PLT) operable to be conveyed within production tubing containing production fluid flow established by zonal fluid flow into the production tubing from zones of a subterranean formation through which the production tubing extends, wherein the PLT comprises: a flow module operable to measure a flow rate of the production fluid flow at each of a plurality of depths associated with a corresponding one of the zones; and a sensor operable to measure proportions of compositional components of the production fluid flow at each of the zone-associated depths; and a controller operable to: determine a flow rate of the zonal fluid flow from each of the zones based on the flow rates of the production fluid flow measured at each of the zone-associated depths; and determine a flow rate of each compositional component of the zonal fluid flow from each of the zones based on: the determined flow rate of the zonal fluid flow from each of the zones; and the proportions of compositional components of the production fluid flow measured at each of the zone-associated depths. The apparatus may further comprise surface equipment comprising the controller.

The PLT may be further operable to measure pressure and temperature of the production fluid flow at each of the zone-associated depths, and the controller may be further operable to determine a compression factor of the production fluid flow at each of the zone-associated depths based on the pressure and temperature of the production fluid flow measured at each of the zone-associated depths. The controller may be operable to determine the flow rate of each compositional component of the zonal fluid flow from each of the zones based further on: the pressure and temperature of the production fluid flow measured at each of the zone-associated depths; and the determined compression factor of the production fluid at each of the zone-associated depths.

The sensor may be operable to measure volumetric proportions of the compositional components of the production fluid flow at each of the zone-associated depths.

The sensor may be operable to measure mass proportions of the compositional components of the production fluid flow at each of the zone-associated depths.

The sensor may comprise a spectrometer, such as a Raman spectrometer.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

conveying a tool within a tubing comprising a zonal fluid flow;

operating the tool to measure a flow rate of fluid flow at each of a plurality of depths, wherein each of the plurality of depths is associated with a corresponding zone in the zonal fluid flow;

determining a flow rate of the zonal fluid flow from each of the zones based on the flow rates of the fluid flow measured at each of the zone-associated depths;

operating the tool to measure proportions of compositional components of the fluid flow at each of the zone-associated depths;

determining a flow rate of each compositional component of the zonal fluid flow from each of the zones based on:

the determined flow rate of the zonal fluid flow from each of the zones; and the proportions of compositional components of the fluid flow measured at each of the zone-associated depths;

operating the tool to measure pressure and temperature of the fluid flow at each of the zone-associated depths; and determining a compression factor of the fluid flow at each of the zone-associated depths based on the pressure and temperature of the fluid flow measured at each of the zone-associated depths;

wherein determining the flow rate of each compositional component of the zonal fluid flow from each of the zones is further based on:

the pressure and temperature of the fluid flow measured at each of the zone-associated depths; and the determined compression factor of the fluid at each of the zone-associated depths.

2. The method of claim 1 wherein operating the tool to measure proportions of the compositional components of the fluid flow at each of the zone-associated depths comprises operating the tool to measure volumetric proportions of the compositional components of the fluid flow at each of the zone-associated depths.

3. The method of claim 1 wherein operating the tool to measure proportions of the compositional components of the fluid flow at each of the zone-associated depths comprises operating the tool to measure mass proportions of the compositional components of the fluid flow at each of the zone-associated depths.

4. The method of claim 1 wherein determining the flow rate of the zonal fluid flow from each of the zones based on the flow rates of the fluid flow measured at each of the zone-associated depths comprises comparing the flow rates of the fluid flow measured at neighboring ones of the zone-associated depths.

5. The method of claim 1 further comprising operating surface equipment in fluid communication with the tubing to establish the zonal fluid flow into the tubing.

6. The method of claim 1 further comprising shutting-in at least one of the zones based on the determined flow rate of at least one of the compositional components of the zonal fluid flow from that at least one zone.

7. The method of claim 1 further comprising varying a drawdown pressure based on the determined flow rate of at least one of the compositional components of the zonal fluid flow from at least one of the zones.

8. A method, comprising:

conveying a production logging tool (PLT) within production tubing containing production fluid flow established by zonal fluid flow into the production tubing from zones of a subterranean formation through which the production tubing extends;

operating the PLT to measure a flow rate of the production fluid flow at each of a plurality of depths associated with a corresponding one of the zones;

determining a flow rate of the zonal fluid flow from each of the zones based on the flow rates of the production fluid flow measured at each of the zone-associated depths;

positioning the PLT adjacent one of the zones and then varying a drawdown pressure while:

operating the PLT to measure proportions of compositional components of the production fluid flow at the PLT-adjacent zone-associated depth; and determining a flow rate of each compositional component of the zonal fluid flow from the PLT-adjacent zone based on:

the determined flow rate of the zonal fluid flow from the PLT-adjacent zone; and the proportions of compositional components of the production fluid flow measured at the PLT-adjacent zone-associated depth;

assessing condensate banking within the PLT-adjacent zone based on the determined flow rate of each compositional component of the zonal fluid flow from the PLT-adjacent zone;

operating the PLT to measure pressure and temperature of the production fluid flow at the PLT-adjacent zone-associated depth; and determining a compression factor of the production fluid flow at the PLT-adjacent zone-associated depth based on the pressure and temperature of the production fluid flow measured at the PLT-adjacent zone-associated depth;

wherein determining the flow rate of each compositional component of the zonal fluid flow from the PLT-adjacent zone is further based on:

the pressure and temperature of the production fluid flow measured at the PLT-adjacent zone-associated depth; and the determined compression factor of the production fluid at the PLT-adjacent zone-associated depth.

9. The method of claim 8 wherein operating the PLT to measure proportions of the compositional components of the production fluid flow at the PLT-adjacent zone-associated depth comprises operating the PLT to measure volumetric proportions of the compositional components of the production fluid flow at the PLT-adjacent zone-associated depth.

10. The method of claim 8 wherein operating the PLT to measure proportions of the compositional components of the production fluid flow at the PLT-adjacent zone-associated depth comprises operating the PLT to measure mass proportions of the compositional components of the production fluid flow at the PLT-adjacent zone-associated depth.

11. The method of claim 8 further comprising shutting-in the PLT-adjacent zone based on the determined flow rate of at least one of the compositional components of the zonal fluid flow from the PLT-adjacent zone.

12. An apparatus, comprising:

a tool operable to be conveyed within tubing containing fluid flow established by zonal fluid flow into the tubing from zones of a subterranean formation through which the tubing extends, wherein the tool comprises:

a flow module operable to measure a flow rate of the fluid flow at each of a plurality of depths associated with a corresponding one of the zones; and a sensor operable to measure proportions of compositional components of the fluid flow at each of the zone-associated depths; and wherein the tool is further operable to measure pressure and temperature of the fluid flow at each of the zone-associated depths; and a controller operable to:

determine a flow rate of the zonal fluid flow from each of the zones based on the flow rates of the fluid flow measured at each of the zone-associated depths; and determine a flow rate of each compositional component of the zonal fluid flow from each of the zones based on:

the determined flow rate of the zonal fluid flow from each of the zones; and the proportions of compositional components of the fluid flow measured at each of the zone-associated depths wherein the controller is further operable to determine a compression factor of the fluid flow at each of the zone-associated depths based on the pressure and temperature of the fluid flow measured at each of the zone-associated depths, such that the controller is operable to determine the flow rate of each compositional component of the zonal fluid flow from each of the zones based further on:

the pressure and temperature of the fluid flow measured at each of the zone-associated depths; and the determined compression factor of the fluid at each of the zone-associated depths.

13. The apparatus of claim 12 further comprising surface equipment comprising the controller.

14. The apparatus of claim 12 wherein the sensor is operable to measure volumetric proportions of the compositional components of the fluid flow at each of the zone-associated depths.

15. The apparatus of claim 12 wherein the sensor is operable to measure mass proportions of the compositional components of the fluid flow at each of the zone-associated depths.

16. The apparatus of claim 12 wherein the sensor comprises a spectrometer.

17. The apparatus of claim 12 wherein the sensor comprises a Raman spectrometer.

* * * * *